US005479748A

United States Patent [19]

Siller

[11] Patent Number: 5,479,748

[45] Date of Patent: Jan. 2, 1996

[54] FRICTION CONNECTOR FOR ANCHORING REINFORCEMENT TENDONS IN REINFORCED OR PRE-STRESSED CONCRETE GIRDERS

[76] Inventor: Jose L. Siller, Miguel Angel 78, Mexico, D.F. C.P., Mexico, 03910

[21] Appl. No.: 998,480

[22] Filed: Dec. 30, 1992

[30] Foreign Application Priority Data

Jan. 7, 1992 [MX] Mexico ..... 9200051

[51] Int. Cl.[6] ..... E04C 3/20

[52] U.S. Cl. ..... 52/231; 52/223.8

[58] Field of Search ..... 52/231, 223.8, 52/223.9, 223.14, 223.13, 223.11, 741.1, 741.3; 29/897.1, 897.35, 897.34; 264/228

[56] References Cited

U.S. PATENT DOCUMENTS

| | | | |
|---|---|---|---|
| 1,970,966 | 8/1934 | Leake | 29/897.1 |
| 2,822,068 | 2/1958 | Hendrix | 52/223.12 |
| 3,010,257 | 11/1961 | Naillon | 52/223.9 |
| 3,140,764 | 7/1964 | Cheskin | 52/223.12 |
| 3,368,016 | 2/1968 | Birguer | 264/228 |
| 3,427,773 | 2/1969 | Kandall | 52/223.13 |
| 3,738,071 | 6/1973 | Finsterwalder | 52/223.14 X |
| 4,704,830 | 11/1987 | Magadini | 52/223.12 |
| 5,313,749 | 5/1994 | Conner | 52/223.12 |

*Primary Examiner*—Rodney M. Lindsey
*Attorney, Agent, or Firm*—Darby & Darby

[57] ABSTRACT

The tensile strength of pre-stressed or reinforced concrete girders for bridges is considerably increased by the addition of at least one layer of external tendons which are stressed under tension between a pair of friction connectors attached near the ends of the girder, each said friction connector comprising a base plate, means attached to the lower face of the base plate for receiving and stressing under tension said layer of tendons, means for pressing the upper face of the base plate against the lower surface of the girder, and means for increasing the friction coefficient between the upper face of the base plate and the lower face of the girder to an extent sufficient to fix the position of the connector solely by friction on said girder.

14 Claims, 2 Drawing Sheets

FRICTION CONNECTOR FOR ANCHORING REINFORCEMENT TENDONS IN REINFORCED OR PRE-STRESSED CONCRETE GIRDERS

FIELD OF THE INVENTION

The present invention refers to the technique of reinforcing or repairing reinforced or pre-stressed concrete girders installed in road or railroad bridges and, more particularly, it is related to a friction connector for anchoring tensioned reinforcement steel rods or tendons in pre-stressed or reinforced concrete elements, such as girders of road or railroad bridges.

BACKGROUND OF THE INVENTION

It is well known that a large number of concrete superstructures of the kind used for road or railroad bridges and which have been built a long time ago, are presently operating with considerably decreased coefficients of safety as compared to the safety coefficients of the original designs, because of causes that definitely diminish to a great extent the load capacity of concrete structures. Among such causes of failure, the following may be mentioned as the most important ones: the high increase in the movable loads that circulate over said bridges; the periodic but continuous stressing of the girders of bridges, which render the concrete materials more brittle, thus originating failures due to fatigue; the prolonged exposure of the tension steel rods and elements to the direct corrosive action of the environment; the vehicle accidents which cause impacts against the superstructures of bridges; and also the rather frequent constructional defects, including design failures.

It is also well known that many techniques for reinforcing or repairing concrete bridges have been developed in the past, among which the most important one, in view of the fact that it is very frequently used for reinforcing or repairing concrete bridges of different spans, is the technique that renders said bridges semi-continuous. Said well known technique comprises introducing compression elements between the headers of the girders, which permits the placement of a perpendicular supporting diaphragm at the center of the span of the girders such that it will project outwardly of the sides of the outer girders, in order to serve as a "violin strings bridge" for a plurality of tendons, the ends of which are attached to each girder, said tendons being passed over the upper edge of the supporting diaphragm, thus forming broken lines in vertical planes, and being finally anchored in foundation blocks that are placed behind the diaphragms of the buttresses. The steel cables or tendons are then introduced within polyethylene sheaths and are thereafter injected with cement slurry. This method, however, results very costly in view of the fact that all the reinforcement steel must be replaced, and is also very slow and requires relatively long lasting traffic interruptions which, added to the type of protection of the tendons, that renders their inspection practically impossible and their maintenance very difficult, together with the vulnerability of polyethylene against fire, rodents and environmental agents that age and destruct the same very quickly, and finally in view of the fact that the cement slurry is pulverized with the thermal contractions, offers a very limited type of protection and consequently is not very appropriate for the purpose of effectively repairing or reinforcing concrete girders for bridges.

On the other hand, in order to reinforce prestressed concrete girders for bridges, the systems utilized up to the present date are even more costly and practically imply the building of an additional super-structure which will support the existent structure, inasmuch as they require a considerable increase in the concrete sections and enormous anchoring diaphragms, together with a relatively large amount of over-reinforcement elements in order to absorb the shearing stresses, and new tendons with sufficient capacity to replace the prior tendons, whereby the cost of repairing is significantly increased and the weight of the structure is increased to a very substantial extent, which may even very frequently necessitate additional reinforcement of the sub-structures.

Consequently, it may be concluded that none of the prior art methods described above has fulfilled the purpose of providing an efficient system to reinforce or repair prestressed or reinforced concrete girders for bridges at a reasonable cost and without the need of stopping the traffic which normally runs over the bridges.

OBJECTS OF THE INVENTION

Having in mind the defects of prior art systems for reinforcing or repairing pre-stressed or reinforced concrete girders for bridges, it is an object of the present invention to provide a friction connector for attaching additional reinforcing tendons to girders, which will avoid the drawbacks of the prior art methods, and will be capable of effectively reinforcing bridges in a very economical manner.

Another object of the present invention is to provide a friction connector of the above character, which will practically convert reinforced concrete bridges into partially pre-stressed concrete bridges, and will also increase to a high extent the load capacity of the same.

One additional object of the present invention is to provide a friction connector of the above character, which will provide a system of extremely long duration for repairing old bridges, without appreciably affecting the previously existent structures thereof.

One other object of the present invention is to provide a friction connector of the above described nature, which will be easily accessible for continuous maintenance and inspections.

It is another object of the present invention to provide a friction connector of the above mentioned character, which will be very simple, light-weight and economical, and nevertheless will be highly efficient and reliable for repairing or reinforcing girders of road or railroad bridges.

One other object of the present invention is to provide a friction connector of the above mentioned character, which will permit the reinforcement or repairing of road or railroad bridges, without interrupting the traffic of vehicles over the bridge at any time.

The foregoing objects and others ancillary thereto are preferably accomplished as follows:

According to a preferred embodiment of the present invention, a friction connector for adding a plurality of reinforcing tendons is attached solely by friction at each header of a girder, each said friction connector essentially comprising a base plate having an upper surface for contacting the lower surface of the girder, said upper surface of the base plate being provided with a plurality of ribs arranged transversely of the length of the girder to provide a high friction coefficient, means for pressing said base plate against the lower surface of the girder, the latter preferably being provided with a high degree of roughness to increase the friction coefficient thereof, and means on the other surface of the base plate for supporting a plurality of tendons such that said tendons may be stressed under tension between a pair of friction connectors.

BRIEF DESCRIPTION OF THE DRAWINGS

The novel features that are considered characteristic of the present invention are set forth with particularly in the appended claims. The invention itself, however, both as to its organization and its method of operation, together with additional objects and advantages thereof, will best be understood from the following description of specific embodiments when read in connection with the accompanying drawings, in which:

DETAILED DESCRIPTION

Figure 1:
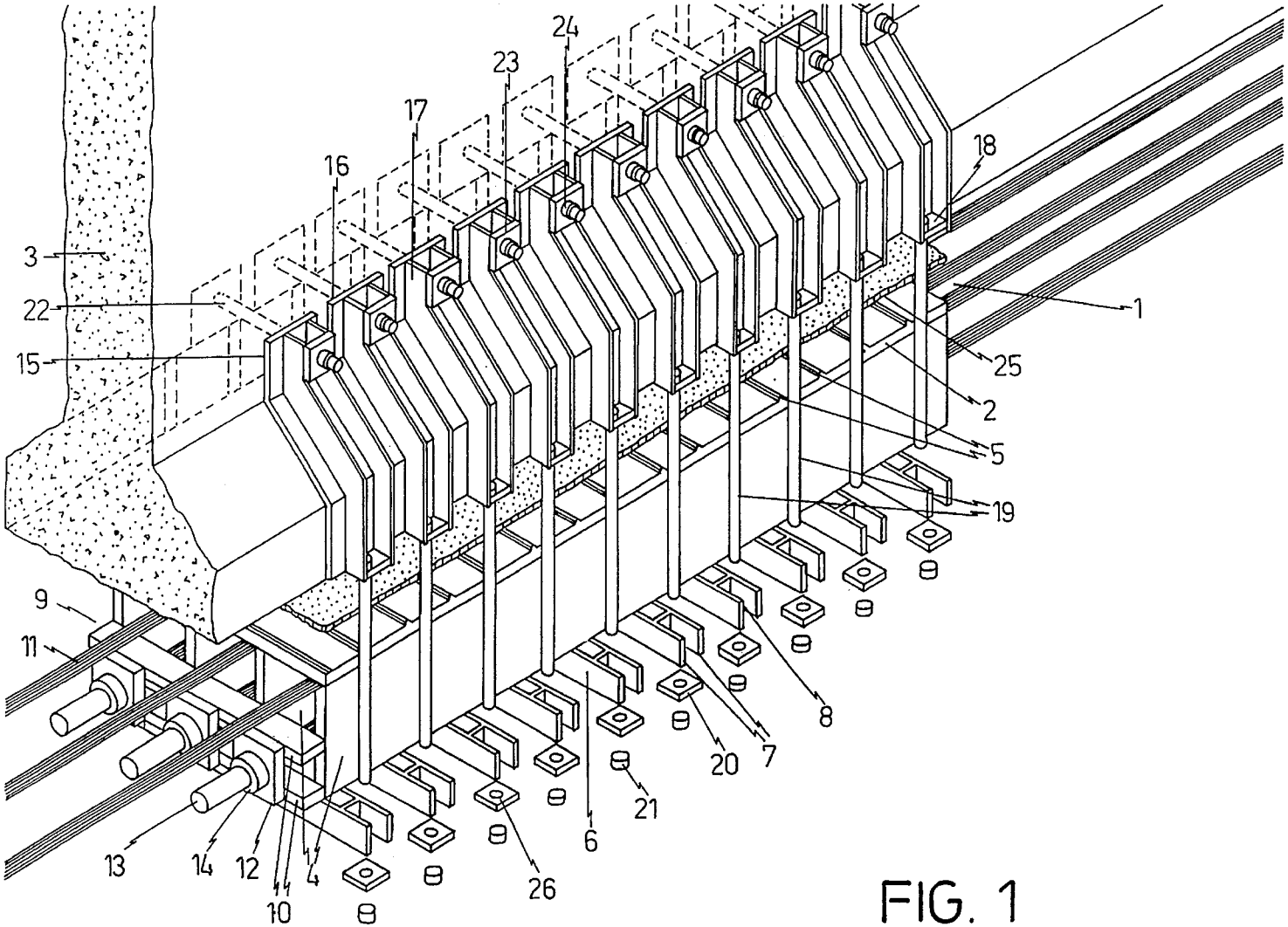
FIG. 1 is a perspective view seen from above, of a friction connector for anchoring tension reinforcement steel in pre-stressed or reinforced concrete girders, built in accordance with a preferred embodiment of the present invention.

Having now particular reference to the drawings and more specifically to FIG. 1, there is shown a friction connector 1, for anchoring tension reinforcement steel in pre-stressed or reinforced concrete elements, built in accordance with a specific embodiment of the present invention and which generally comprises a metal base plate 2, which contacts the lower face of a girder 3 to be reinforced or repaired, which adopts the shape of the tension flange of said concrete girder 3, said base plate preferably being of a rectangular and planar shape, and preferably built from steel, having a length and a thickness which are variable in accordance with the design specifications, but which width is equal to the width of the tension flange of the girder 3, the cross section of which is selected from a "bulb" or trapezoidal shape, although any other shape of those normally utilized in the building of concrete bridges may also be included without departing from the scope of the invention.

The base plate 2 also comprises a plurality of elongated steel plates 4 attached along the lower or outer face of the base plate, two of said elongated plates matching the longitudinal edges of the base plate 2, while the remaining elongated plates are distributed parallely to each other and transversely to the length of base plate 2 at equal distances between the longitudinal edges of the base plate 2, in order to provide the necessary stiffness and therefore prevent the deformation of the base plate when the same is subjected to the additional tensile force which will be added to the girder 3. The base plate 2 is provided, over its upper or contact face that confronts the lower surface of said girder 3, with a plurality of ribs 5, crosswisely located throughout the length of said surface and with said ribs being parallel to each other. The ribs 5, however, may be may be replaced by any other type of projections, grooves, bores, etc., since the purpose of the same is that of providing said inner or contact face of the base plate with the highest roughness or harshness possible.

A plurality of crosswisely extending supporting beams 6 are placed under the longitudinally extending elongated plates 4 in order to form a supporting bed which extends from end to end of the contact base plate 2. These beams, besides supporting said base plate 2, will serve at the same time as stiffening crosswise elements for the base plate. Each one of the beams 6 is built by means of a pair of parallel elongated plates 7 preferably made of steel and abutting against said base plate, suitably engaged to each other near their ends by means of metal spacers 8 in order to provide the required transverse rigidity or stiffness when the base plate 2 is pressed against the lower face of the girder 3. At least one tendon-supporting beam 9 is crosswisely arranged against the ends of the elongated plates 4 which stiffen the base plate 2, said tendon-supporting beam comprising a pair of elongated plates 10, preferably made of steel, abutting on the edges thereof over the ends of the elongated plates 4 and being more rugged than the elongated plates 7 of the beams 6, and a plurality of perforated thick plates 12 distributed along the same, in order to support the ends of the tendons 11.

At least one layer of tendons 11 are externally installed, in proximity to the tension flange of the girder 3 in order to reinforce the same, which tendons may be wires, rods, bars or cables, etc., said tendons 11 being fastened to the supporting beam 9 by means of anchors 13 which are housed within the plates 12 of said beam 9, said anchors being selected from any type of anchors existing in the market, preferably having threads at the ends, which are preferably adjusted by means of nuts 14 of a preferably cylindrical shape.

A plurality of supporting steel fittings which in accordance with the embodiment of FIG. 1 adopt the shape of the side contour of the bulb of the flange of girder 3, and are placed over the side slope of the same, said steel fittings 15 being formed by a supporting plate 16 having at least a bore at its upper end, said plate 16 including a pair of folds in the sections which match each one of the longitudinal edges of the side slope of the girder, which gives the plate the shape of a stylized "S" as seen in perspective, two metallic plates 17 of complementary shape for lateral stiffening, perpendicularly attached and parallely arranged along the length of the outer surface of the supporting plate 16, and an angular lug 18 which is placed perpendicularly to the vertical face of the girder, at the lower end of the supporting steel fitting 15 and between said plates 17, in order to define the spacing therebetween, said lug 18 having a bore at the center of the same.

A plurality of pressing members 19 which are preferably threaded steel bolts having a high resistance and having a head at its upper end and a thread at its lower end, and being provided with the diameter and length suitable to meet the design specifications, vertically pass through the bores of the lugs 18, the head of the screw being firmly supported on said lugs 18. Bolts 19 pass between the elongated plates 7 which form each one of the supporting beams 6, and through the bore 26 provided on a square washer 20, such that the free end of each bolt 19, after passing through the square washer 20, may be tightened by means of a nut 21, preferably cylindrical, in order to provide a connector firmly supported on the base of the girder.

A plurality of fasteners 22 preferably formed by threaded bolts having a suitable strength to meet the design specifications, pass through the web of the concrete girder 3, and engage at its upper part a pair of steel fittings 15, by means of respective square washers 23 and cylindrical nuts 24, in order to fix the position of said steel fittings 15 by opposite pairs.

A layer of cement mortar 25 is placed between the base plate 2 and the surface of the flange of girder 3 preferably previously bushhammering said surface to provide sufficient roughness in order to generate a suitable friction against the contact base plate 2.

The preferred system for tightening all the nuts against the respective bolts, is the one known as hydraulic tensioning by spacement, in order to permit both the nuts and the bolt heads to be preferably cylindrical, which shape renders them less susceptible to tampering than the hexagonal nuts and bold heads, thus remarkably minimizing the risk to vandalic actions. Also, the hydraulic tensioning may accomplish a high precision in the desired torque, taking into consideration the thermal variations of the region where the system is installed.

If required, more than one layer of tendons 11 may be provided, by the mere expedient of providing more width to the elongated plates 4 which accomplish the longitudinal stiffening of the base plate 2, and with the consequent incorporation of pressing bolts 19 of a larger length, such that the tendons of the layer or layers of tendons will pass between each pair of elongated plates 4, next to the plates 12 without any interference with each other, such as is shown in FIG. 1.

As the design regulations for structures do not permit the use of bolts which cross a concrete member such as a girder to provide an anchoring base which will rely on the resistance of the material against shearing stresses, and taking into consideration that the necessary force to produce the sliding of two contacting surfaces in relation to each other mainly relies on the pressure that maintains said surfaces together and on the friction force or friction coefficient that exists therebetween, the lower or outer face of the tension flange of the girder 3 is preferably subjected to a bushhammering operation in order to remove the smooth surface of the concrete and transform the same into a harsh, rough and strongly frictioning surface.

As the base plate 2 is reinforced and totally stiffened by its lower and outer face and is sufficiently harsh on its upper or inner face, a layer of mortar 25 in a plastic state, having approximately 10 mm thickness, is placed between said harsh surface of the base plate 2 and the bushhammered surface of the tension flange of the girder 3 as already described above, with the purpose of producing a friction coefficient at least equal to 1. For accomplishing this goal, said layer of mortar 25 is preferably constituted by a plastic mortar with a high content of hydraulic cement, sand and a commercial additive having expansive properties and a high strength to shearing stresses, in order to totally fill all the cavities of both rough surfaces, whereby when pressing the base plate 2 against the lower or outer face of the tension flange of girder 3 by means of the tightening of bolts 19, the additional tensile force which is produced by the layer of tendons 11 anchored on the supporting beam 9 will be transmitted by pressure-friction to the concrete girder 3.

For each layer or tendons 11 which may be desired to add to the girder 3, two friction connectors 1 of the present invention are required, which friction connectors must be identical, Collinear and symmetrically opposite, one at each end of each layer of tendons 11. The friction connectors 1 located nearer to the center of the length of the girder, will be provided with wider elongated beams 4 to allow passage therethrough of the other layer of tendons that are anchored to friction connectors located nearer to the extreme ends of the girder, as will be apparent to any one skilled in the art.

Figure 2:
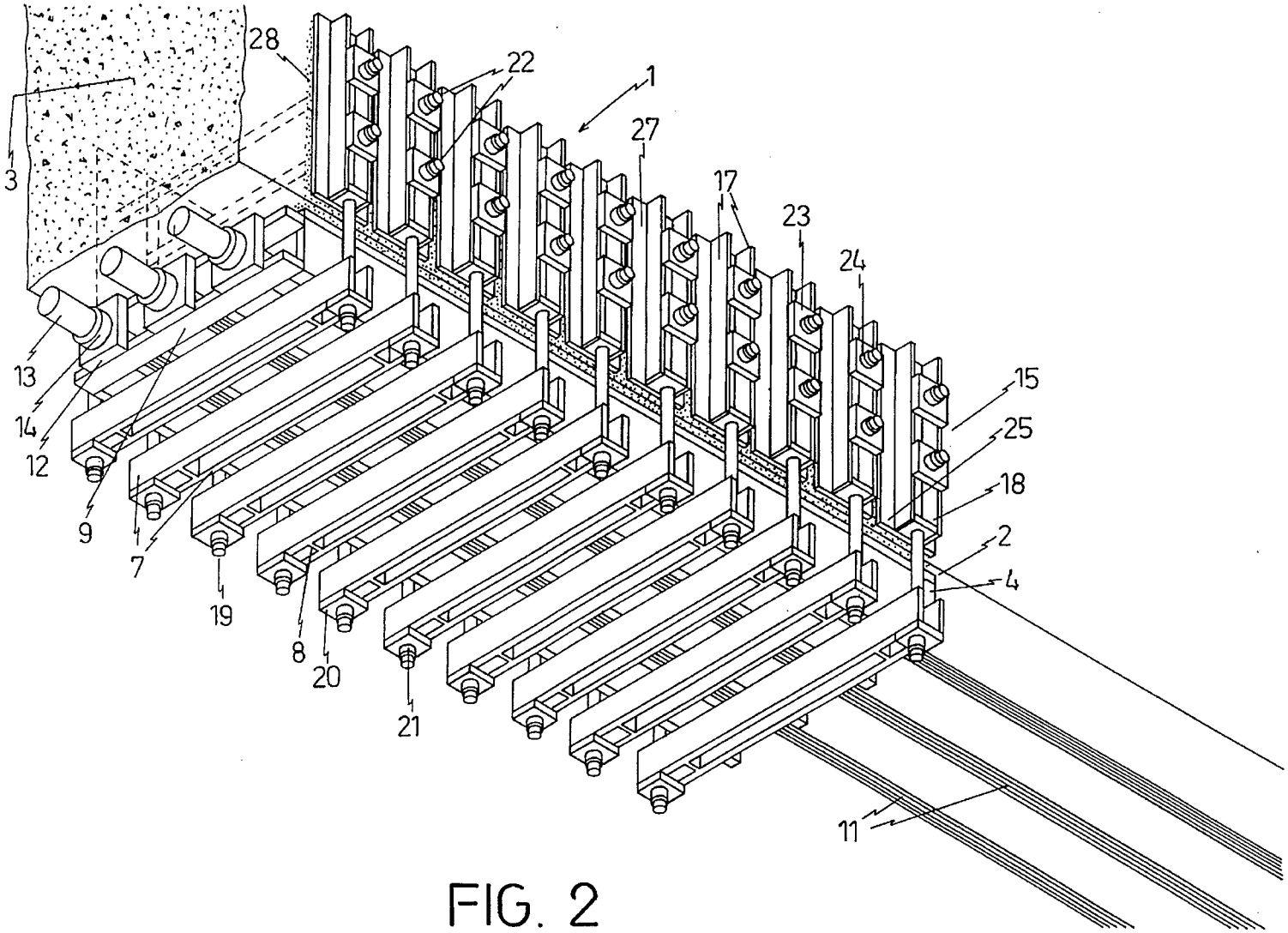
FIG. 2 is a perspective view seen from below, of a friction connector for anchoring tension reinforcement steel in pre-stressed or reinforced concrete girders, built in accordance with a second embodiment of the present invention.

In concrete bridges built by means of girders, two main types of girders are used, each one having a different cross section, namely, "bulb" type girders and "trapezoidal" type girders. When the girder to be reinforced is of the bulb type, the metallic supporting fittings 15 are supported on the side slope of the concrete girder 3, such as previously described having reference to the embodiment illustrated in FIG. 1. However, when the girder to be reinforced is a trapezoidal or rectangular girder as the one shown in FIG. 2, the present invention offers a second embodiment for the solution of the problem, which will permit the incorporation of at least one layer of tendons 11 such as is shown in FIG. 2. The friction connectors in accordance with this second embodiment of the present invention include certain differences with respect to the friction connectors for use with girders of the bulb type as those shown in FIG. 1, in view of the fact that, in order to anchor the supporting metallic fittings 15, the same technique used for pressing the base plate 2 against the bottom surface of the girder, by anchoring the fittings 15 against the side slopes of the flange of the girder 3 by friction can no longer be used, because the side slope of the flange of the girder 3 to support said fittings 15 does not exist.

Therefore, in the second embodiment of the invention shown in FIG. 2, a plurality of seating plates 27 for supporting the fittings 15 is provided, with each seating plate 27 having a plurality of projections on its inner face, which extend inwardly of the side surface of the girder 3, whereby they are not shown in FIG. 2, in order to give the plates 27 the necessary roughness. Also, respective layers of the same special mortar described above, identified by the reference numeral 28 in FIG. 2, are incorporated in the plastic state between the plates 27 and the concrete surface of the web of the girder, preferably previously bushhammering the same in order to remove the surface layer of smooth concrete and provide the necessary roughness, in a form similar to that already described in connection with the base plate 2 of FIG. 1. The metallic supporting fittings 15 are pressed and supported by pairs against the web of the girder 3 at least in 2 points along the same, by means of the fasteners 22 crossing from side to side the concrete web of the girder through bores previously made though said web of the girder 3 and in the plates 27 of the fittings 15, such that said supporting metallic fittings 15 will operate exclusively by friction and will not apply shearing stresses on the web of the girder.

With the purchase of providing a long life to all the metallic components of the friction connector 1 of the present invention, it is preferred to subject the same to a galvanizing step, which treatment is also used for the high strength elements that constitute the tendons.

From the above it may be seen that the friction connector of the present invention provides a practical and functional solution to the problems presently existent in the reinforcement or repairing of concrete girders of road or railroad bridges, which are normally seriously damaged and therefore operate with very low safety coefficients after a predetermined period of time. The friction connector of the present invention, by being coupled solely by friction to the tension face of a reinforced concrete structural element or of a pre-stressed concrete element subject to flexure, such as the girders of bridges, permits the transmission, by friction, of the tensile force which is produced by a new layer of external tendons that are anchored between a pair of friction connectors fixed at the ends of the girders, from said tendons directly to the girder, without subjecting the latter to the undue shearing stresses that are normally applied on the girders when the connectors for the added tendons are not attached by friction to said elements.

The friction transmission of the added tensile force is obtained by strongly pressing the rigid contact plate 2 against the outer face of the tension flange of the girder 3, which has been previously bushhammered in order to render it rough or harsh, with a layer of about 10 mm of expansive mortar having a high resistance being placed between both surfaces, and by installing and stressing under tension the tendons in the pair of opposite connectors when only one single layer of tendons is used, or between similar and opposite connectors when more layers of tendons are used. By these means, the connectors according to the present invention will be firmly fastened to the flange of the girder, thus permitting the development of a friction coefficient at least equal to 1 which will avoid the possible sliding of the above mentioned surfaces.

It is to be against mentioned that if the concrete girder is of the bulb section type in the tension flange, then the metallic supporting fittings for the tendons, that serve to press the base plate against the outer face of the girder, will rest on the side slope of the flange, but if on the contrary, the section of the girder is rectangular or trapezoidal, then the metallic supporting fittings will be fastened by means of friction against the sides of the web of the girder in a manner similar to that in which the contact base plate is fastened, and by means of simultaneous fastening bolts that cross the web of the girder to support by pairs said fittings, such that the connectors thusly mounted will serve as an anchoring bank for the new tension elements that will be added.

Although certain specific embodiments of the present invention have been shown and described above, it is to be understood that many modifications thereof are possible. The present invention, therefore, is not to be restricted except insofar as is necessitated by the prior art and by the spirit of the appended claims.

What is claimed is:

1. A friction connector for reinforcing or repairing reinforced or pre-stressed concrete girders comprising a web, an upper or compression section and a lower or tension section having a lower face with a predetermined width, said friction connector comprising:

a base plate having an upper face, a lower face, a width equal to the width of the lower face of the tension section of the girder and a length sufficient to provide a suitable friction force against the lower face of the tension section of the girder;

means to press said upper face of said base plate against the lower face of the tension section of the girder;

means for increasing the friction between said upper face of said base plate and the lower face of the tension section of the girder;

a plurality of elongated plates and reinforcing tendons, the elongated plates being integrally attached to said lower face of said base plate and extending longitudinally thereof in order to form longitudinal channels for permitting the passage of the reinforcing tendons therethrough;

at least one tendon-supporting beam attached to one of the end of each one of said elongated plates and extending perpendicularly thereto;

means for anchoring a layer of reinforcing tendons to said tendon-supporting beam; and means for tightening said tendons against said tendon-supporting beam in order to increase the tensile strength of the tension section of the girder.

2. A friction connector according to claim 1 wherein said means for pressing said base plate against the lower face of the tension section of the girder comprise a plurality of channel shaped fittings extending vertically downwardly on the sides of the tension section of the girder, means to maintain the position of said fittings on the girder, each fitting having a perpendicular lug closing the channel shaped fitting at the lower end thereof, each lug having a central bore, a corresponding plurality of bolts passing through the bores of said lugs and extending downwardly thereof past the lower edges of said elongated plates, a corresponding plurality of base plate engaging members, horizontally placed below the lower edges of said elongated plates and perpendicularly extending thereto, the length of said base plate engaging members being sufficient to span the full width of said base plate and to permit the ends thereof to project a predetermined distance beyond each edge of said base plate, and means at each projecting end of said base plate engaging members for tightening the bolts, whereby said base plate is tightened against the lower surface of the tension section of the girder.

3. A friction connector according to claim 2 wherein said base plate engaging members have their two projecting ends built such that said plurality of bolts are permitted to pass freely therethrough and the means to tighten the bolts comprise a washer abutting against the lower surface of each projecting end of said base plate engaging members such that a thread at the lower end of said bolts is threadably engaged to a complementary threaded nut to tighten said bolts against said washers.

4. A friction connector according to claim 3 wherein the girder is of the bulb type having a rectangular web and at least a flange at its lower or tension edge, the upper face of said flange being a sloping surface which forms an outwardly and downwardly extending slope between the flange and the web.

5. A friction connector according to claim 3 wherein the girder is of the trapezoidal section type having a rectangular cross section.

6. A friction connector according to claim 4 wherein the means to maintain the position of said fittings on the sides of the girder comprise a washer integrally fixed at the upper end of each channel shaped fitting, a bore at the center of said washer, a collinear bore at the bottom of the channel of said fitting, and a bolt and nut assembly passing through said bores and through collinear bores provided through the web of the girder, in order to press a pair of opposite channel shaped fittings, one at each side of the girder, said channel shaped fittings having a longitudinal shape which follows the contour of each side of the tension section of the girder, thereby bearing on the side slope of the flange of the girder for fixing their position thereon.

7. A friction connector according to claim 5 wherein the means to maintain the position of said fittings on the sides of the girder comprise a plurality of washers integrally fixed along the length of each channel shaped fitting, a bore at the center of each washer, a corresponding plurality of collinear bores at the bottom of the channel of said fitting, and respective bolt and nut assemblies crossing from side to side the concrete web of the girder through said bores of each washer and through collinear bores provided through the concrete web of the girder, in order to press a pair of opposite channel shaped fittings, one at each side of the girder, said channel shaped fittings having a straight longitudinal shape, the inner surface of said fittings and the side surfaces of the tension section of the girder being provided with a rough finish, and a layer of expansive cement mortar with the purpose of producing a friction coefficient inserted between said surfaces in order to maintain by friction the longitudinal position of said fittings on the girder.

8. A friction connector according to claim 1 wherein the means for increasing the friction coefficient between said upper face said base plate and lower face of the tension section of the girder comprise a plurality of projections on said upper face of said base plate, roughness providing means on the lower face of the girder, and a layer of cement mortar having a high resistance to shearing stresses and expansive characteristics upon curing, sandwiched between said upper face of said base plate and the lower face of the girder.

9. A friction connector according to claim 8 wherein said plurality of projections on said upper face of said base plate comprise a plurality of parallel ribs extending transversely to the length of said base plate at short distances from each other.

10. A friction connector according to claim 1 wherein the means for increasing the friction between said upper face of said base plate and the lower face of the tension section of the girder comprise a plurality of cavities on said upper face of said base plate, roughness providing means on the lower face of the girder, and a layer of cement mortar having a high resistance to shearing stresses and expansive characteristics upon curing, sandwiched between said upper face of said base plate and the lower face of the girder.

11. A friction connector according to claim 8 wherein said roughness providing means on the lower face of the girder comprise a bushhammered finish of said lower face of the girder.

12. A friction connector according to claim 10 wherein said roughness providing means on the lower face of the girder comprise a bushhammered finish of said lower face of the girder.

13. A friction connector according to claim 1 wherein said channel-forming elongated plates attached to said lower face of said base plate have a width sufficient to allow the passage of at least one additional layer of tendons between said lower face of said base plate and the upper edge of the tendon-supporting beam for the first layer of tendons, said at least one additional layer of tendons passing therefore through the entire length of the connector to be engaged to and stressed against at least one additional friction connector located nearer to the extreme end of the girder.

14. A friction connector according to claim 13 wherein each layer of tendons is stressed under tension between a pair of opposite friction connectors.

* * * * *